United States Patent [19]

Ishii

[11] Patent Number: 4,662,423

[45] Date of Patent: May 5, 1987

[54] DEVICE FOR OPERATING ROLL-SCREEN

[75] Inventor: Kaname Ishii, Chiba, Japan

[73] Assignee: Kabushiki Kaisha Nichibei, Japan

[21] Appl. No.: 546,056

[22] Filed: Oct. 27, 1983

[30] Foreign Application Priority Data

| | | | |
|---|---|---|---|
| Oct. 31, 1982 | [JP] | Japan | 57-164973[U] |
| Jun. 22, 1983 | [JP] | Japan | 58-94963[U] |
| Jun. 22, 1983 | [JP] | Japan | 58-94964[U] |
| Aug. 12, 1983 | [JP] | Japan | 58-125595[U] |

[51] Int. Cl.[4] ..... E06B 9/208

[52] U.S. Cl. ..... 160/293 R

[58] Field of Search ..... 160/294, 293, 295, 298, 160/299, 301, 304

[56] References Cited

U.S. PATENT DOCUMENTS

| | | | |
|---|---|---|---|
| 2,040,301 | 5/1936 | Fay | 160/293 R |
| 2,204,847 | 6/1940 | Ebsworth | 160/293 R |

*Primary Examiner*—Ramon S. Britts

*Assistant Examiner*—Cherney S. Lieberman

*Attorney, Agent, or Firm*—Toren, McGeady and Goldberg

[57] ABSTRACT

A device for operating a roll-screen having a winding roll for winding up a screen cloth thereon, which comprises a changeover wheel and a guide wheel in confronting relation with each other, one of which is rotated with the winding roll in screen raising and lowering directions and the other of which is rotated with the winding roll only in the screen lowering direction, the wheels being so arranged that when the screen cloth is lowered two wheels are rotated together, when the screen cloth is stopped and subjected to screen raising force the one wheel is not rotated in screen raising direction due to engagement thereof with the other wheel, and when the roll is slightly rotated in screen lowering direction the one wheel is released from the other wheel whereby the one wheel is freely rotated to make the winding roll wind up the screen cloth thereon.

3 Claims, 16 Drawing Figures

DEVICE FOR OPERATING ROLL-SCREEN

BACKGROUND OF THE INVENTION

1. Field of the Invention

The present invention relates to a device for operating a roll-screen and, more particularly, a device for raising, lowering and stopping a screen cloth of a roll-screen.

2. Description of the Prior Art

The conventional roll-screen includes a screen cloth, a winding roll for winding up the screen cloth, a coil spring connected to the winding roll to continually applying resilient force to rotate it in its cloth winding-up direction and a ratchet device which utilizes centrifugal action acting thereon to stop said screen cloth at a desired lowered position. When it is desired to raise the screen cloth, said cloth is slightly pulled downwardly to release said ratchet device from the winding roll, thereby allowing the screen cloth to be wound up onto the winding roll under the action of said coil spring.

According to the mechanism for raising, lowering and stopping the screen cloth of the conventional roll-screen, it is very difficult to stop the screen cloth at a desired height.

SUMMARY OF THE INVENTION

It is a general object of the present invention to eliminate the above-mentioned defect in the conventional roll-screen.

It is a specific object of the present invention to provide a device for operating a roll-screen in which a changeover device having simple construction is employed in place of the ratchet device, to enable the screen cloth to be stopped surely at a desired position.

In accordance with the present invention there is provided a device for operating a roll-screen having a screen cloth, a winding roll for winding up the screen cloth thereon and a coil spring connected to the winding roll to continually apply elastic force to said winding roll to rotate it in its cloth raising direction, which comprises a changeover wheel and a guide wheel arranged in confronting relation with each other, one of said wheels being rotatable with said winding roll in its cloth raising and lowering directions, the other of said wheels being rotatable with said winding roll only in its cloth lowering direction, said changeover wheel having a pawl member slidably mounted thereon and projecting toward the guide wheel, said guide wheel having a guideway for receiving the free end of said pawl member, said guideway including a guide portion for moving the pawl member on the changeover wheel in one direction when the winding roll is rotated in its cloth lowering direction, a first pawl rest portion for stopping the movement of the pawl member relative to the changeover wheel and then causing the guide wheel and the changeover wheel to be rotated together in the cloth lowering direction when the winding roll is continuously rotated in its cloth lowering direction, a second pawl rest portion for receiving the pawl member when the winding roll is stopped and then rotated in the opposite direction under the action of said coil spring connected to the winding roll, and an escape path for releasing the pawl member from said second pawl rest portion when winding roll is slightly rotated in its cloth lowering direction, thereby allowing the free rotation of the winding roll in its cloth raising direction.

BRIEF DESCRIPTION OF THE DRAWINGS

The drawings illustrate several preferred embodiments of the present invention, in which:

FIG. 8(*b*) is a side view of the same;

DETAILED DESCRIPTION OF THE PREFERRED EMBODIMENTS

Figure 1:
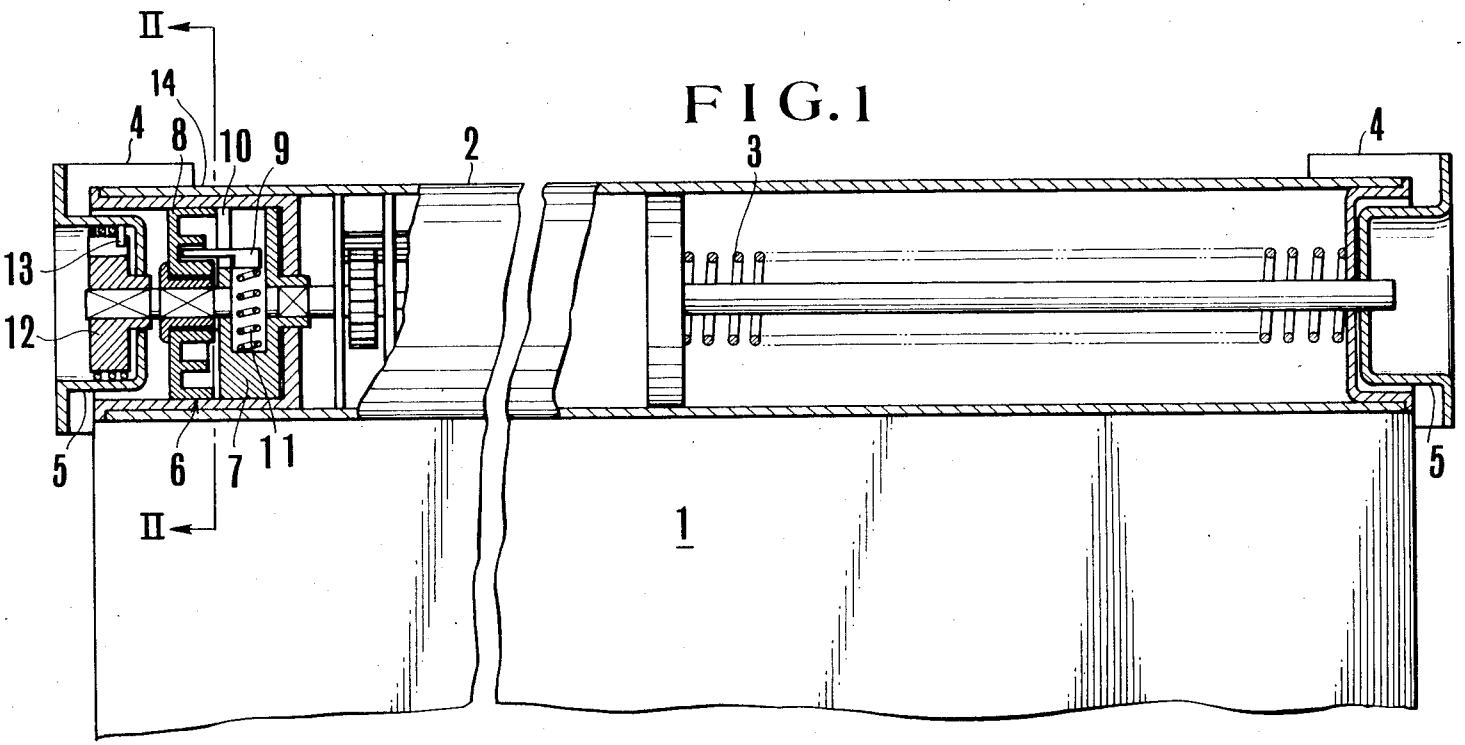
FIG. 1 is a front view, partly broken, of a roll-screen including an embodiment of the invention.

FIG. 1 illustrates the first embodiment of the present invention. The roll-screen shown in FIG. 1 comprises a screen cloth 1, a winding roll 2 for winding up the screen cloth thereon, a coil spring 3 for continually applying elastic force to said winding roll to rotate it in the cloth winding-up direction and brackets 4 having bearing portions 5 for pivotally supporting the winding roll 2 at its both ends.

6 indicates the operating device for raising, lowering and stopping the screen cloth of the roll-screen according to the present invention, which is arranged at one end of said winding roll.

The device according to the present invention comprises a changeover wheel 7 arranged at one end of said winding roll 2 in coaxial relation thereto and a guide wheel 8 arranged in axially confronting relation to said changeover wheel.

The guide wheel 8 is connected to said winding roll 2, so that said guide wheel is rotatable with said winding roll in its cloth raising direction as well as in its cloth lowering direction. The changeover wheel 7 is supported by the bearing portion 5 so that it is rotatable with said winding roll only in its cloth lowering direction. For this purpose, a one-way clutch spring 13 is disposed between the peripheral surface of a drum 12 fixed to the shaft of the changeover wheel 7 and the inside surface of the bearing portion 5. The one-way clutch spring is well known in the art, and therefore further detailed explanation is omitted.

The changeover wheel 7 has a pawl member 9 which projects therefrom in axial direction toward the guide wheel 8 and is slidably mounted thereon for sliding movement in radial direction. In the embodiment shown in FIG. 1, a radial guide groove 10 is formed in the changeover wheel 7 and the pawl member 9 is slidably mounted at its base portion in said guide groove 10. A resilient means, i.e. spring 11 is arranged to continually bias said pawl member 9 in radially outward direction.

The guide wheel 8 has a guideway for receiving the free end of the pawl member 9 which projects from the changeover wheel 7 into said guide, passage.

Figure 2:
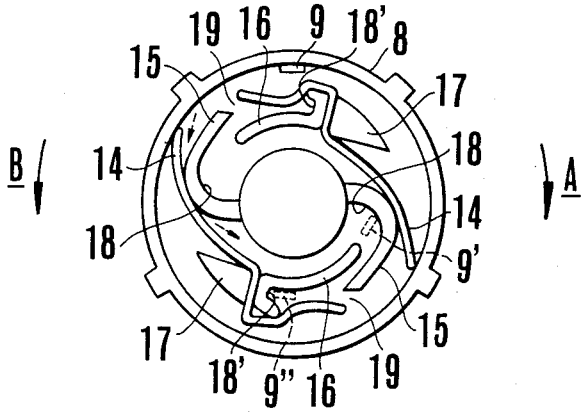
FIG. 2 shows a preferred form of the guide wheel shown in FIG. 1.

An embodiment of the guide wheel 8 is shown in FIG. 2. The guideway formed on the guide wheel 8 includes guide portions 14, first pawl rest portions 18, second pawl rest portions 18' and pawl escape paths 19.

The guide portion 14 is made of a spring blade, which is so arranged that when the winding roll is rotated in its cloth lowering direction as indicated by an arrow A in FIG. 2 said guide portion 14 comes into contact with the pawl member 9 to move it in the radially inward direction against the action of the spring 11, and when the winding roll is rotated in its cloth raising direction as indicated by an arrow B in FIG. 2 said guide portion 14 made of spring blade can override the pawl member 9, thereby allowing free rotation of the guide wheel 8. In the embodiment shown in FIG. 2, the guide wheel 8 has projections 15, 16 and 17 integrally formed on the wall surface thereof, and the guide portion 14 made of spring blade is supported by said projections 15, 16 and 17 and is resiliently pressed at its free end against the inside surface of the peripheral wall of the guide wheel.

The first pawl rest portion 18 is so constructed that when the rotation of the winding roll is continued in its cloth lowering direction said portion 18 stops the sliding movement of the pawl member 9 on the changeover wheel 7 and then causes the guide wheel 8 and the changeover wheel to be rotated together in the cloth lowering direction. In FIG. 2, the pawl rest portions 18 are formed on the inside of the respective projections 15. That is, when the rotation of the guide wheel 8 connected to the winding roll is continued in the cloth lowering direction, the pawl member 9 comes to the position indicated by 9' in FIG. 2, and thus the changeover wheel 7 becomes rotated with the guide wheel 8 in the cloth lowering direction. At this stage, the rotation of the winding roll acts to loosen the one-way clutch spring 13, so that the changeover wheel 7 can make its free rotation.

The second pawl rest portion 18' is so arranged that when the rotation of the winding roll in its cloth lowering direction is stopped and then the winding roll is rotated in the opposite direction, i.e. cloth raising direction, under the action of the coil spring 3, said rest portion 18' comes into contact with the pawl member, as shown by 9''. The changeover wheel 7 cannot rotate in the cloth raising direction under the action of the one-way clutch spring 13, and therefore the rotation of the winding roll in the cloth raising direction is stopped by the engagement of the second pawl rest portion 18' with the pawl member 9''.

The pawl escape path 19 is so arranged that when the winding roll is slightly rotated in the cloth lowering direction the pawl member 9 is released from the second rest portion 18' and is moved in radially outward direction under the action of the spring 11. In the embodiment shown in FIG. 2, the escape path 19 is formed between the base end of the guide spring 14 and the projection 15. When the pawl member 9 passes through said escape path 19 in the radially outward direction, the pawl member 9 comes into the passage where the guide spring 14 can override the pawl member 9 to allow free rotation of the guide wheel, so that the winding roll 2 is rotated to wind up the cloth thereon.

Figure 3:
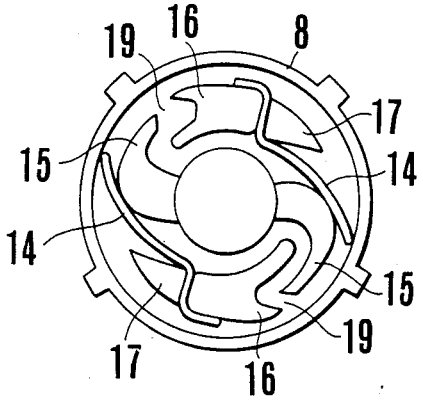
FIG. 3 shows a modified form of the guide wheel.

FIG. 3 illustrates a modified form of the guide wheel. The guide wheel shown in FIG. 3 is substantially same as that shown in FIG. 2, except that the guide spring 14 is not used to form the escape path 19, which is formed between the projections 15 and 16.

Figure 4:
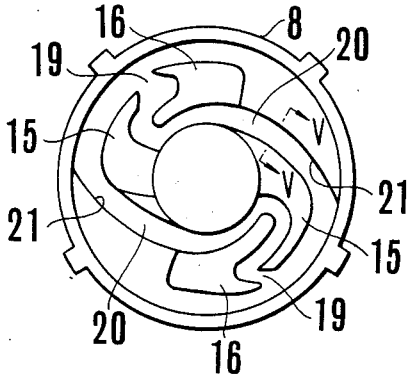
FIG. 4 shows another modified form of the guide wheel.
Figure 5:
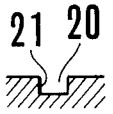
FIG. 5 is a section taken along line V—V in FIG. 4.

FIG. 4 illustrates another modified form of the guide wheel. This guide wheel is substantially same as that shown in FIG. 2, except that the guide portion for moving the pawl member in radially inward direction when the winding roll is rotated in its cloth lowering direction is constituted by a guide groove 20 formed in the wall of the guide wheel, as shown in FIG. 5 to form a step portion 21.

The operation of this embodiment is substantially same as that of the guide wheel as explained above. When the guide wheel 8 is rotated in the cloth lowering direction the step portion 21 comes into engagement with the pawl member to move it in the radially inward direction, and when the guide wheel 8 is rotated in the cloth raising direction, the pawl member only drops from the flat part into the groove 20 and slides in said groove 20, so that the rotation of the guide wheel 8 is not disturbed by the pawl member.

When it is desired to lower the screen cloth, the cloth 1 is pulled downward. The winding roll 2 is rotated in its cloth lowering direction and the guide wheel 8 is also rotated therewith. The pawl member 9 is moved in radially inward direction on the changeover wheel 7 under the guidance of the guide portion 14 until the pawl member 7 comes to the first rest portion 18. Thereafter, the continued rotation of the guide wheel 8 is transmitted to the changeover wheel 7, which becomes rotated with the guide wheel in the cloth lowering direction. At this stage, the one-way clutch spring 13 is loosened, so that the rotation of the winding roll is not arrested thereby. After the screen cloth is lowered to a desired position and the lowering operation is stopped, the winding roll is subjected to rotating force of the coil spring 3 in the opposite direction.

Owing to this rotating force, the guide wheel is rotated so that the pawl member 9 comes off the first rest portion 18 and comes into contact with the second rest portion 18', as shown by 9'', where the rotation of the guide wheel is stopped and the cloth is held at the desired position. When it is desired to raise the screen cloth, said screen cloth is slightly pulled downward. The guide wheel is rotated in the opposite direction, so that the pawl member comes off the second rest portion 18'' and it is moved in radially outward direction by the action of the spring 11. Thus the pawl member passes through the escape path 19 to the outward position, where the guide wheel can make free rotation and thus the winding roll 2 acts to wind up the screen cloth thereon.

Figure 7:
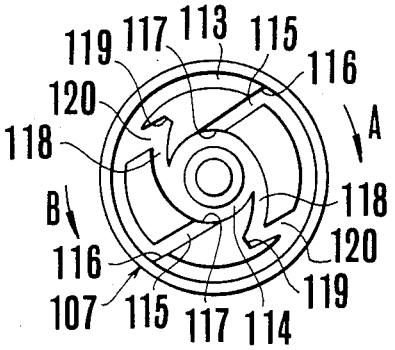
FIG. 7 is a preferred form of a guide wheel shown in FIG. 6.
Figure 6:
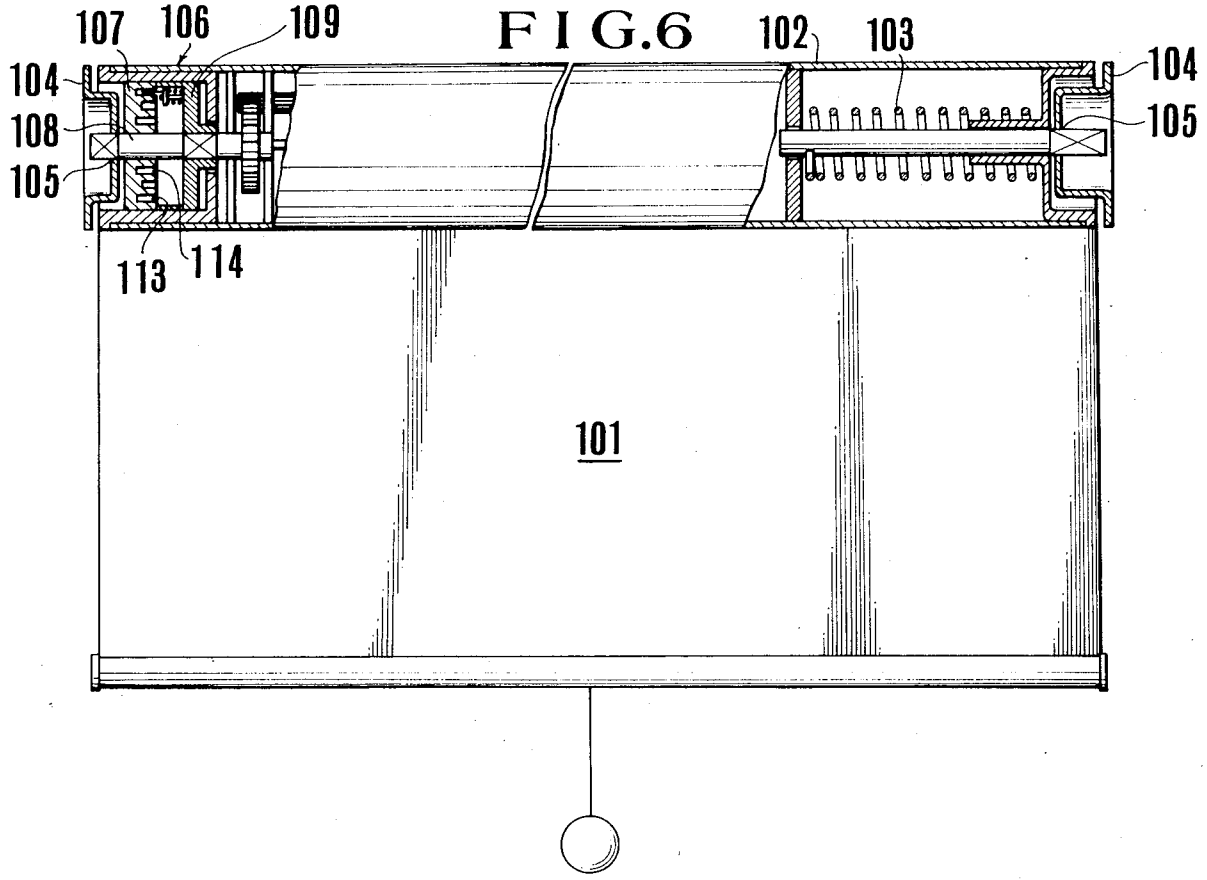
FIG. 6 is a front view, partly broken, of a roll-screen including another embodiment of the present invention.
Figure 8A:
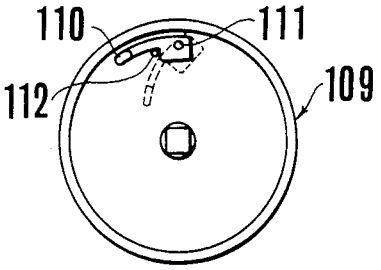
FIG. 8(*a*) is a front view of a changeover wheel shown in FIG. 6.
Figure 8B:
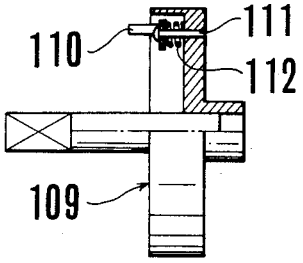

FIGS. 6 to 8 illustrate another embodiment of the present invention. The roll-screen shown in FIG. 6 comprises a screen cloth 101, a winding roll 102 for winding up the screen cloth thereon, a coil spring 103 for continually applying elastic force to said winding roll to rotate it in the cloth winding-up direction and brackets 104 having bearing portions 105 for pivotally supporting the winding roll 102 at its both ends.

106 indicates the operating device for raising, lowering and stopping the screen cloth of the roll-screen according to the present invention, which is arranged at one end of said winding roll.

The device according to the present invention comprises a guide wheel 107 arranged at one end of said winding roll 102 in coaxial relation thereto and a changeover wheel 109 arranged in axially confronting relation to said guide wheel.

The guide wheel 107 is connected to said winding roll 2, so that said guide wheel is rotatable with said winding roll in its cloth raising direction as well as in its cloth lowering direction. The changeover wheel 109 is supported on the shaft 108 which is supported by bearing portion 105.

The changeover wheel 109 has a pawl member 110 which is movable in radial direction as well as axial direction. The pawl member 110 shown in FIGS. 6 to 8 is mounted on the free end of an arm which is mounted at its base end on a shaft 111 which is slidably and rotatably mounted on the changeover wheel. The pawl member 110 is resiliently biased in axial direction toward the guide wheel as well as in radially outward direction by a spring 112.

The a guide wheel 107 has a guideway which receives the end of the pawl member. The guideway includes an outer peripheral groove 113 and an inner peripheral groove 114. The guideway further includes an inlet groove 115 for guiding the pawl member 110 from the outer groove 113 to the inner groove 114. A step 116 is formed at the junction of the groove 113 and the groove 115 to introduce the pawl 110 into the inlet groove 115 against the action of the spring 112 during the rotation of the guide wheel in the cloth lowering direction. That is, during the rotation of the guide wheel 107 in the cloth lowering direction as indicated by an arrow A, the pawl 110 comes into engagement with the step portion 116, which acts to introduce the pawl member into the inlet groove 115, while during the rotation of the guide wheel 107 in the cloth raising direction as indicated by an arrow B, the pawl member 110 overrides the step 116, so that the pawl member 110 freely moves in the groove 113. At the position of the step 116, the outer peripheral groove 113 has a tapered bottom surface, to which the end of the pawl 110 is resiliently pushed by the action of the spring 112.

The guideway further includes a step 117 at the junction of the inlet groove 115 and the inner peripheral groove 114, so that the pawl member can pass from the inlet groove 115 into the inner peripheral groove 114 but it cannot pass from the groove 114 into the groove 115. The pawl 110 is always pushed against the bottom surface of the inner peripheral groove, and during the rotation of the guide wheel 107 in the direction of the arrow A, it moves in the groove 114.

The guideway further includes an outlet groove 118 into which the pawl 110 is introduced under the action of the spring 112 during the rotation of the guide wheel 107 in the cloth raising direction as indicated by the arrow B, a pawl rest portion 119 formed at the end of said groove 118 and an escape groove 120 for allowing the pawl 110 to be escaped from the rest portion 119 to the outer peripheral groove 113.

Now, the operation will be described.

When lowering the cloth, the guide wheel 107 is rotated with the rotation of the winding roll in the direction as indicated by the arrow A. The pawl 110 in the guide wheel 107 moves along the outer peripheral groove 113 and when it comes into contact with the step 116, it is introduced into the inlet groove 115. Then the pawl 110 passes beyond the step 117 into the inner peripheral groove 114. During the cloth lowering operation, the pawl 110 is located in the inner peripheral groove 114, so that the guide wheel 107 can freely rotate, independently of the pawl 110, to allow the screen cloth to be lowered to a desired position.

When the cloth is lowered to a desired position and is released, the guide wheel 107 is rotated in the direction indicated by the arrow B under the action of the spring 103, the pawl 110 is introduced into the outlet groove 118 by the action of the spring 112 which acts to apply resilient force to the pawl 110 in radially outward direction, and then said pawl 110 comes to engagement with the rest portion 119. Accordingly, the pawl 110 serves to prevent further rotation of the guide wheel 107, so that the cloth is stopped at this position. When the guide wheel 107 is rotated in the direction as indicated by the arrow B, the step portion 117 formed at the boundary between the inner groove 114 and the inlet groove 115 serves to prevent the pawl 110 from being introduced into the inlet groove 115, so that the pawl 110 is necessarily introduced into the outlet groove 118.

When it is desired to raise the cloth, the cloth is slightly pulled to rotate the guide wheel 107 by a small angle in the direction as indicated by the arrow A. The pawl 110 passes through the escape path 120 under the action of the spring 114 until it enters into the outer peripheral groove 113. If the cloth is released at this stage, the guide wheel 107 is rotated in the cloth raising direction as indicated by the arrow B under the action of the spring 103, thereby winding up the cloth on the winding roll. During the rotation in the direction B, the pawl 110 overrides the step portion 116 in the groove 113, so that the guide wheel make continuous rotation to wind up the screen cloth on the winding roll.

Figure 10:
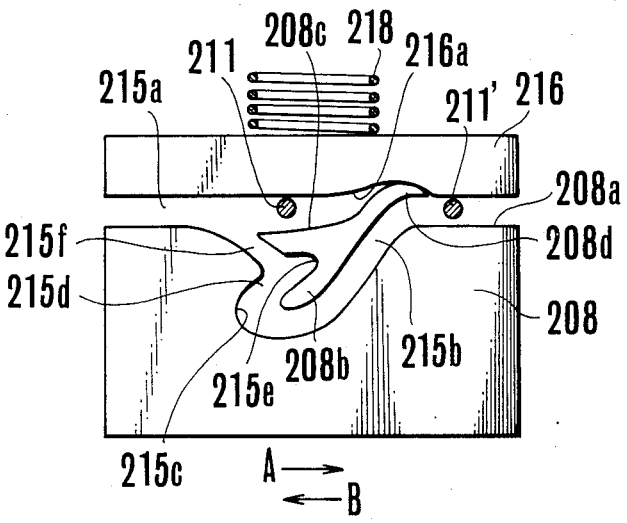
FIG. 10 is a developed view of a guideway formed in a guide wheel shown in FIG. 9.
Figure 9:
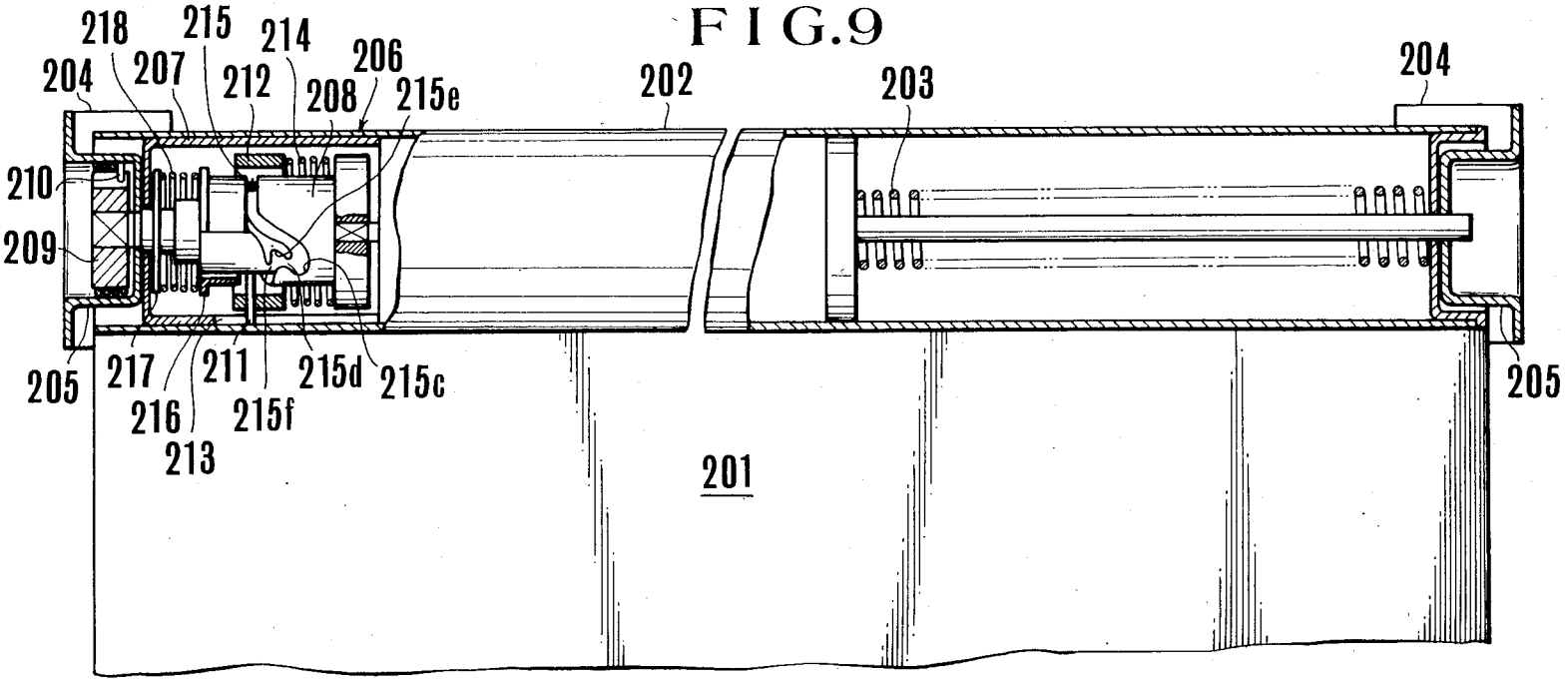
FIG. 9 is a front view, partly broken, of a roll-screen including a further embodiment of the present invention.
Figure 11:
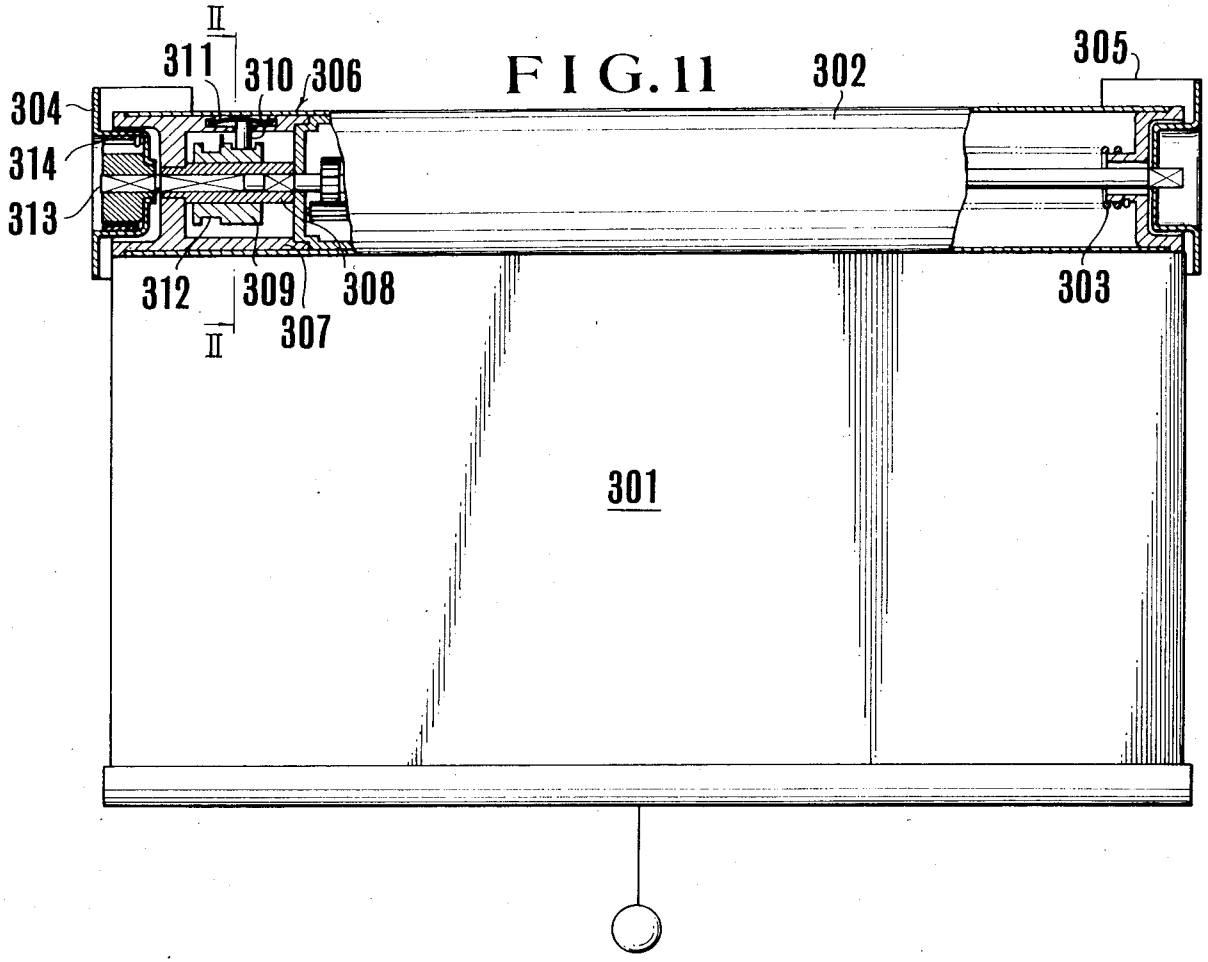
FIG. 11 is a front view, partly broken, of a roll-screen including another embodiment of the present invention.
Figure 12:
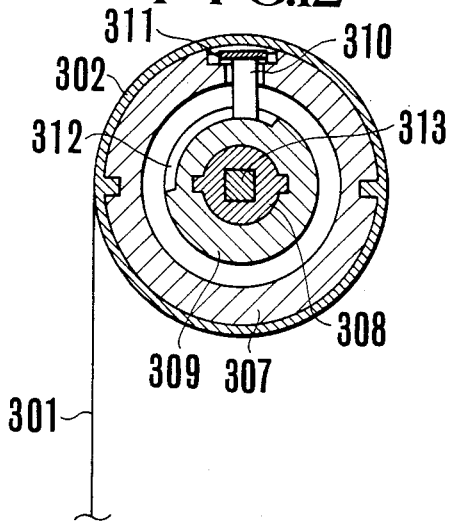
FIG. 12 is a sectional view of the embodiment shown in FIG. 11.

FIGS. 9 and 10 illustrate another embodiment of the present invention. The roll-screen includes a cloth 201, a winding roll 202, a coil spring 203, brackets 204, bearing portions 205 and an operating device 206 according to the present invention.

The device 206 comprises a changeover wheel 207 in the form of a tube and a guide wheel 208 in the form of a drum which is arranged in the wheel 207 in coaxial relation therewith and rotatable relatively thereto. One of the wheels 207 and 208 is connected to the one end of the winding roll, while the other of said wheels is mounted on the bearing portion 205 so that it can rotate only in the cloth lowering direction. In the embodiment shown in FIGS. 9 and 10, the guide wheel 208 is connected to the roll 202, while the changeover wheel 207 is mounted on the bearing portion 205 through a one-way clutch spring 210, which is identical with that described in the previously explained embodiments.

The changeover wheel 207 has a changeover pawl supporting drum 212 which has a changeover pawl 211 projecting in radially inward direction and which is fixed in peripheral direction, but slidable in axial direction relatively to said changeover wheel. In the illustrated embodiment, the outer end of the pawl 211 is slidably engaged in an axial groove 213 formed in the changeover wheel 207, so that the rotation of the changeover wheel 207 causes the pawl supporting tube 212 to rotate therewith and consequently causes the pawl 211 to rotate around the guide wheel 208. The pawl 211 is axially slidable relatively to the changeover wheel 207.

A compression spring 214 is arranged between the pawl supporting tube 212 and the enlarged portion of the guide wheel 208 in order to resiliently bias the pawl in one direction, that is in leftward direction in the drawings.

The guide wheel 208 has a guideway 215 formed in its peripheral surface which receives the free end of the pawl. The guideway 215 includes a free groove portion 215*a* through which the pawl 211 can freely move when the winding roll 202 is rotated in the cloth raising direction by the action of the coil spring 203. In order to form the free groove 215*a*, a guide sleeve 216 is fitted on said guide wheel 208 for axially slidable movement thereon and a compression spring 218 is arranged between a ring 217 fixed at the end of the guide wheel 208 and the guide sleeve 216 to resiliently push the sleeve 216 to the end of the guide wheel 208.

The developed form of the guideway is illustrated in FIG. 10. The guide sleeve 216 has a guide face 216*a*, which forms the free groove 215*a* between said face and the guide face 208*a* of the guide wheel 208. The pawl 211 engages in said free groove 215*a*. The guide wheel 208 has a projection 208*b* which has an inclined face 208*c* and a top 208*d*, which is resiliently pushed against the guide face 216*a* of the guide sleeve 216 under the action of the spring 218. During the rotation of the winding roll in its cloth raising direction, the pawl 211 moves in the direction indicated by an arrow A in FIG. 10 and passes between the guide face 216*a* of the guide sleeve 216 and the inclined face 208*c* of the projection 208*b*, while moving the guide sleeve 216 against the action of the spring 218, so that the pawl can freely pass between the guide sleeve 216 and the guide wheel 208. Accordingly, during the rotation of the winding roll in its cloth raising direction, the guide pawl 211 freely passes through the free groove 215*a*, so that the winding roll can freely rotate to wind up the cloth thereon.

The guideway includes an inlet groove 215*b* which guides the pawl 211 in the rightward direction as viewed in FIG. 9 against the action of the spring 214 when the roll 202 is rotated in the cloth lowering direction. The inlet groove 215*b* is formed at one side of the projection 208*b*, and the pawl 211 is introduced into the inlet groove 215*b* against the action of the spring 214 when the pawl 211 moves from the position 211′ in the direction indicated by an arrow B owing to the rotation of the winding roll 202 in the cloth lowering direction. A first pawl rest portion 215*c* is formed at the end of said groove, which serves to stop the pawl 211. If the rotation of the winding roll in its cloth lowering direction is continued, the changeover wheel 207 and the guide wheel 208 are rotated together. The rotation of the changeover wheel 207 in the cloth lowering direction is allowed by the one-way clutch spring 210, so that the cloth can be lowered to a desired position.

The guideway includes an outlet groove 215*d* into which the pawl is introduced under the action of the spring 214 when the cloth has been stopped and then the winding roll is rotated in its cloth raising direction. A second pawl rest portion 215*e* is formed at the end of this groove, and the pawl 211 is stopped at this portion 215*e*, so that the raising of the cloth owing to the coil spring 203 is stopped.

The guideway further includes an escape path 215*f* which allows the pin 211 to be escape from the rest portion 215*e* to the free groove portion 215*a* under the action of the elastic biasing force of the spring 214, when the winding roll 202 is rotated in the cloth lowering direction. That is, when the cloth stopped at the desired position is pulled down, the pin 211 enters into the free groove 215*a*, and thereafter the winding roll can make free rotation under the action of the spring 203 to wind up the cloth on the winding roll.

The operation of this embodiment is substantially same as that of the previous embodiments.

FIGS. 11 to 15 illustrate a further embodiment of the present invention.

The roll-screen includes a cloth 301, a winding roll 302, a coil spring 303, brackets 304 and 305 and a device 306 according to the present invention.

The device according to the present invention comprises an outer tubular changeover wheel 307, a center rotary shaft 308 and a guide wheel 309 which is mounted on the rotary shaft so that it is fixed in peripheral direction but slidable in axial direction relatively to the shaft. The changeover wheel 307 has a pawl 310 which projects in radially inward direction from the inside surface of the wheel and is resiliently retractable under the action of a blade spring 311. The guide wheel 309 is rotatable with the rotary shaft 308 and is slidable in axial direction, and it has a guideway 312 thereon.

The rotary shaft 308 has a center shaft 313 fixedly connected thereto and the outer end of said shaft 313 is connected to the bracket 304 through the one-way clutch spring 314 which acts to permit free rotation of the shafts 313 and 308 during cloth lowering operation but block the rotation of these shafts during cloth raising operation.

The guideway 312 includes a free groove 312*a* through which the changeover pawl 310 can freely pass while the winding roll 302 is rotated in its cloth raising direction by the action of the spring 303, an inlet groove 312*b* into which the pawl 310 is introduced when the winding roll 302 is rotated in cloth lowering direction, a first pawl rest portion 312*c* formed at the end of said groove 312*b*, an outlet groove 312*d* into which the pawl 310 is introduced when the winding roll is rotated in the cloth raising direction after the pawl has come into engagement with the first rest portion 312*c*, a second pawl rest portion 312*e* formed at the end of said outlet groove, and an escape groove 312*f* through which the pawl 310 passes to the free groove when the winding roll is rotated in cloth lowering direction.

Figure 14:
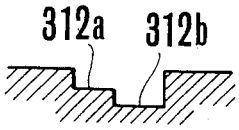
FIGS. 14 and 15 are sectional views showing portions of the guideway, respectively.
Figure 15:
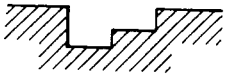

A step portion is formed at the boundary between the free groove 312*a* and the inlet groove 312*b* as shown in FIG. 14, which allows the pawl 310 to freely pass through the free groove 312*a* when the winding roll is rotated in its cloth raising direction, while said step prevents the pawl 310 from entering into the free groove 312*a* and allows the pawl to be introduced into the inlet groove 312*b* when the roll is rotated in the cloth lowering direction. Similar step portions are formed at the boundaries between 312*b* and 312*d*, 312*d* and 312*e*, and 312*e* and 312*a*, as shown in FIG. 15.

Figure 13:
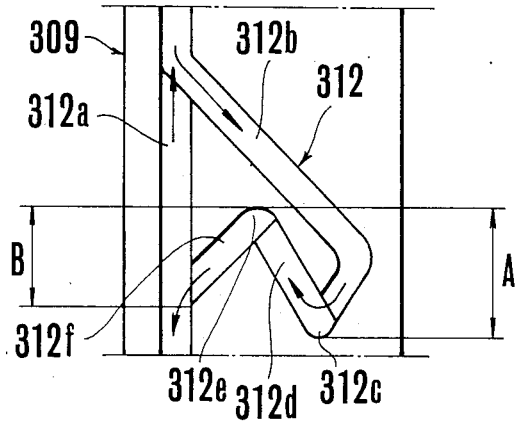
FIG. 13 is a developed view of a guideway formed in a guide wheel shown in FIG. 11.

Accordingly, the pawl 310 can move only in the direction indicated by arrows in FIG. 13 and cannot move in the opposite direction.

The operation of the device shown in FIGS. 11 to 15 is substantially same as that of the devices as explained above.

It will be understood from the above descriptions that the device according to the present invention has the following advantages.

(1) The device is simple in construction and provides reliable operation. When it is desired to lower the screen, the cloth is lowered and stopped precisely at a desired position by pulling down the screen cloth and then releasing the cloth at the desired position. When it is desired to raise the screen, the screen cloth can be wound up onto the winding roll by slightly pulling down the cloth and releasing said cloth.

(2) It is assumed that the distance between the first rest portion and the second rest portion in rotating direction, that is, the vertical distance between the position where the cloth is released after the cloth has been lowered to a desired position and the position where the cloth is stopped after the movement in raising direction is "distance A", and the length of the escape groove in rotating direction, that is, the vertical distance of the slight lowering of the cloth required to cause the cloth to be raised is "distance B". In the device according to the present invention, "the distance B" is made smaller than "the distance A". Then, the lowering distance required to release the locking of the winding roll to produce raising operation of the cloth is smaller than the distance of the backward movement at the time of stopping the cloth, and consequently the operation of the roll-screen can be made in reliable manner. Particularly, if the distance of the backward movement at the time of stopping the cloth was equal to or smaller than the lowering distance required to release the locking of the winding roll, the release of the locking of the winding roll would be impossible after the screen cloth had been lowered to a fully lowered position. This is a most important problem in the conventional roll-screen. According to the present invention, such a defect can be completely avoided.

What I claim:

1. A device for operating a roll-screen having a screen cloth, a winding roll for winding up the screen cloth thereon and a coil spring connected to the winding roll to continually apply elastic force to said winding roll to rotate it in its cloth raising direction, which comprises a changeover wheel and a guide wheel arranged in confronting relation with each other, one of said wheels being rotatable with said winding roll in its cloth raising and lowering directions, the other of said wheels being rotatable with said winding roll only in its cloth lowering direction, a one-way clutch spring in engagement with the other of said wheels so that it is loosened when said winding roll moves in the cloth lowering direction whereby the other of said wheels does not move with said winding roll in the cloth raising direction, said changeover wheel having a pawl member slidably mounted thereon and projecting toward the guide wheel, said guide wheel having a guideway for receiving the free end of said pawl member, said guideway including a guide portion for moving the pawl member on the changeover wheel in one direction when the winding roll is rotated in its cloth lowering direction, a first pawl rest portion for stopping the movement of the pawl member relative to the changeover wheel and then causing the guide wheel and the changeover wheel to be rotated together in the cloth lowering direction when the winding roll is continuously rotated in its cloth lowering direction, a second pawl rest portion for receiving the pawl member when the winding roll is stopped and then rotated in the opposite direction under the action of said coil spring connected to the winding roll, and an escape path for releasing the pawl member from said second pawl rest portion when winding roll is slighty rotated in its cloth lowering direction, thereby allowing the free rotation of the winding roll in its cloth raising direction.

2. A device according to claim 1, in which the changeover wheel having a pawl axially projecting therefrom and radially slidable thereon and a spring for biasing said pawl in radially outward direction is rotatable only in the cloth lowering direction, and the guide wheel having a guideway for receiving the free end of the pawl is fixedly connected to one end of the winding roll.

3. A device according to claim 1, in which the changeover wheel has a radially and axially movable pawl pivotally supported thereon and a spring for biasing said pawl in axially and radially outward directions and the guide wheel is fixedly connected to the winding roll and has a guideway for receiving the free end of the pawl which includes an outer peripheral groove, an inner peripheral groove, an inlet groove for introducing the pawl from the outer peripheral groove to the inner peripheral groove during the rotation of the guide wheel in cloth lowering direction, an outlet groove for introducing the pawl from the inner peripheral groove to the outer peripheral groove during the cloth raising direction, a pawl rest portion formed at the end of said outlet groove and an escape path for passing the pawl from said rest portion to the outer peripheral groove when the guide wheel is slightly rotated in the cloth lowering direction.

* * * * *